US007240404B2

(12) United States Patent
Flössner

(10) Patent No.: US 7,240,404 B2
(45) Date of Patent: Jul. 10, 2007

(54) FASTENING SYSTEM

(76) Inventor: Uwe Flössner, Friedensstrasse 7, 98634 Kaltensundheim/Thüringen (DE)

( * ) Notice: Subject to any disclaimer, the term of this patent is extended or adjusted under 35 U.S.C. 154(b) by 0 days.

(21) Appl. No.: 10/566,014

(22) PCT Filed: Sep. 9, 2004

(86) PCT No.: PCT/DE2004/002005

§ 371 (c)(1),
(2), (4) Date: Jan. 25, 2006

(87) PCT Pub. No.: WO2005/027686

PCT Pub. Date: Mar. 31, 2005

(65) Prior Publication Data

US 2006/0242799 A1 Nov. 2, 2006

(30) Foreign Application Priority Data

Sep. 16, 2003 (DE) ..... 103 42 712
Jan. 17, 2004 (DE) ..... 10 2004 002 522

(51) Int. Cl.
*A44B 21/00* (2006.01)

(52) U.S. Cl. ..... 24/3.7; 24/3.5; 24/3.9; 24/3.1; 224/675; 2/102; 2/101

(58) Field of Classification Search ..... 24/3.7, 24/224; 2/102, 101
See application file for complete search history.

(56) References Cited

U.S. PATENT DOCUMENTS 842,498 A 1/1907 Schmidt
4,419,794 A * 12/1983 Horton et al. ..... 24/667
5,259,093 A 11/1993 Annunzio
5,724,707 A * 3/1998 Kirk et al. ..... 24/3.7
6,279,580 B1 * 8/2001 Perez et al. ..... 128/897
6,295,650 B1 * 10/2001 Baacke ..... 2/94
6,431,424 B1 * 8/2002 Smith ..... 224/583
6,637,547 B1 * 10/2003 Wydner ..... 182/3
7,047,570 B2 * 5/2006 Johnson ..... 2/102

FOREIGN PATENT DOCUMENTS

CA 64 22 44 6/1962
DE 1 803 109 U1 4/1970
DE 38 25 195 A 4/1989

* cited by examiner

*Primary Examiner*—Robert J. Sandy
*Assistant Examiner*—Marcus Menezes
(74) *Attorney, Agent, or Firm*—Collard & Roe, P.C.

(57) ABSTRACT

A fastening system for objects, such as pockets, that can be attached to an item of clothing in various positions includes a mechanism with an interlocking action for objects, e.g. pockets and a buckle located on the object to be fastened to the item of clothing, below the upper fastening region of each fastening strap. The lower section of the contact surface of the object to be fastened to the item of clothing is provided with one or more pocket loops arranged next to one another, their number corresponding to the number of fastening straps that are situated on the object. The free end of the fastening strap(s) that is/are situated on the object is equipped with a respective gripper element including a hook, the element being used to secure the fastening strap(s) to a clothing loop lying below the pocket loop.

8 Claims, 8 Drawing Sheets

FASTENING SYSTEM

CROSS REFERENCE TO RELATED APPLICATIONS

Figure 1:
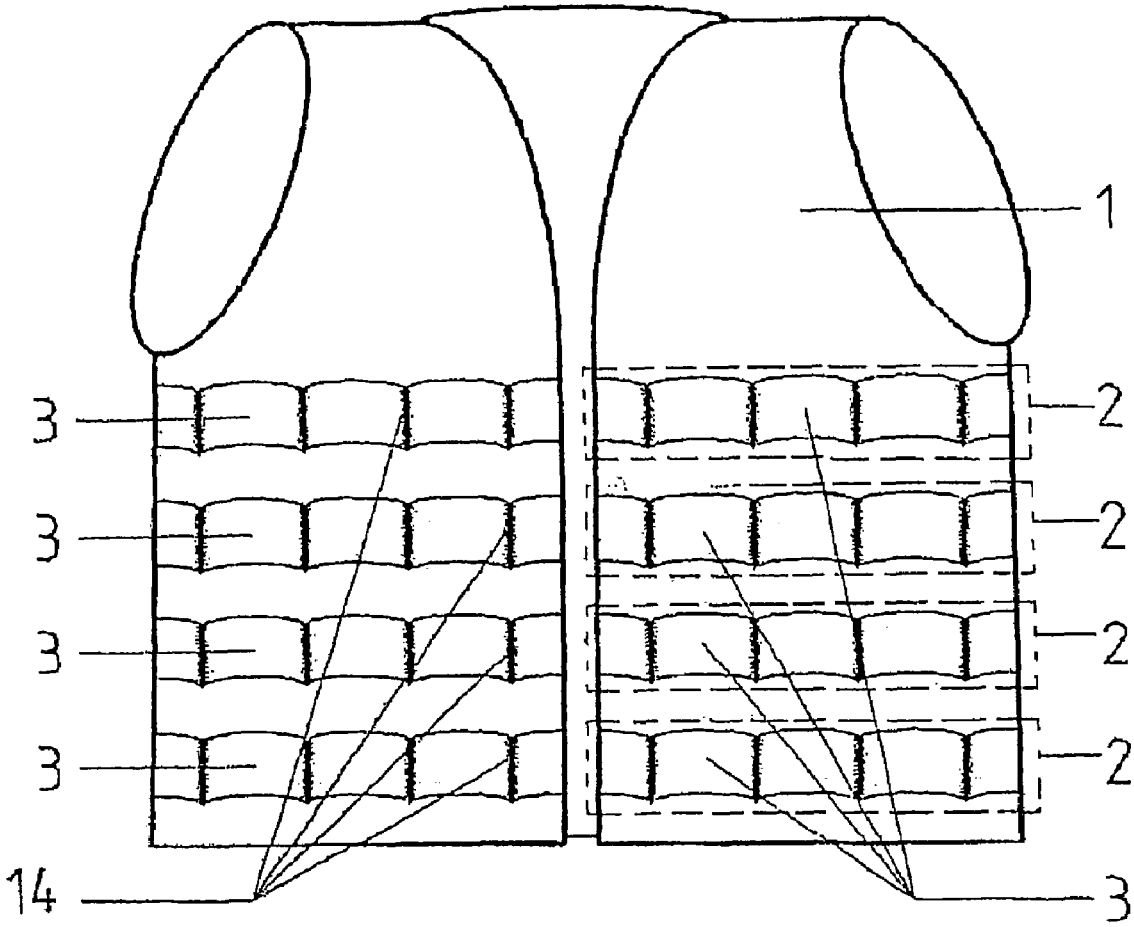

Applicant claims priority under 35 U.S.C. §119 of German Application Nos. 103 42 712.0 and 10 2004 002 522.3 filed Sep. 16, 2003 and Jan. 17, 2004, respectively. Applicant also claims priority under 35 U.S.C. §365 of PCT/DE2004/002005 filed Sep. 9, 2004. The international application under PCT article 21(2) was not published in English.

The invention relates to a fastening system for objects, for example pockets, to be attached to an article of clothing in variable positions, in accordance with the preamble of claim 1.

In the prior art, fastening systems for objects to be attached to an article of clothing in variable positions, by means of an interlocking mechanism of effect, are described previously, for example in CA 64 22 44.

A significant disadvantage of this embodiment, which is characterized by means of the placement of loops on the edges of the two objects to be connected with one another, consists in the fact that a bendable, flexible connecting rod that is braided through the loops is used to connect the element edges.

The use of such a connecting rod, in combination with its placement on articles of clothing, causes pressure points because of the body contact that necessarily occurs.

From U.S. Pat. No. 842,498, a quick-release, also braided closure is known, in which two articles of clothing, for example, again provided with loops that are assigned to one another, can be connected with one another by means of an elastic strap that is alternately passed, one after the other, through the loops of the two parts that are assigned to one another.

To secure the connection, both the lower and the upper end of the connection region is additionally secured by means of a quick closure, in the present case by means of a hook, on the one hand, and by means of a snap, on the other hand.

Furthermore, a closure that is free of buttons and buckles is known from DE 1 803 109 U1, also having loops and straps that connect them, for protective tarps, tents, and articles of clothing, in which the straps to be braided are fixed to one of the two articles of clothing with one end, in each instance. Since the free, other end of the straps is held only by the friction force between the strap and the modules adjacent to it, such a connection results in increased play as the stress between the articles of clothing that are connected with one another increases, so that the closure presented in DE 1 803 109 U1 constantly has to be tightened as the stress increases.

Furthermore, a device for attaching a pocket to a belt by means of an attachment strap disposed on the pocket, forming the belt loop, is known from DE 38 25 195 A1, as well, whereby an additional textile strap that extends over the entire width of the pocket, sewn onto the pocket on both sides, over a certain area, which forms a loop with the back of the pocket in the center region, through which a free end of the attachment strap forming the belt loop, provided with a hook and loop closure, is passed, and subsequently connected with a hook and loop closure disposed on the belt loop of the pocket, so that the attachment strap is positioned in its end position.

While this fastening variant does try to prevent the constant retightening of the releasable connection under stress, it has the disadvantage that the hook and loop closure elements that fix the end position, particularly when using this fastening variant outdoors, easily become blocked up with mud, dirt, lint, or the like, and therefore become unusable. Another fastening variant of a pocket or something similar to a belt or an article of clothing has become known from U.S. Pat. No. 5,259,093 A.

In this connection, several strap bands are sewn onto the back of the pocket, to be replaceably fastened to a vest, for example, in such a manner that the two free ends of each of the strap bands project beyond the pocket. Reinforcement elements are disposed at the two free ends of each strap band. At the same time, there are insertion slits in the region of the back of the pocket, at the top and the bottom, into which these reinforcement elements disposed on the free ends of the strap bands are then inserted from above and from below, respectively, and thereby wedged in place.

On the related article of clothing, for example the vest, several strap band strips that are uniformly spaced apart, in each instance, are disposed one above the other in the crosswise direction, which are connected with the vest multiple times, by means of perpendicular attachment seams that are uniformly spaced apart, in such a manner that these strap band strips form loops that are disposed above one another and next to one another, with the article of clothing, for example the vest.

The strap band strips sewn onto the vest in this manner, which are uniformly spaced apart, in each instance, form loops that lie precisely (in rows and columns) next to and above one another, having a uniform geometry, and thereby allow freely selectable, precise positioning of a pocket by means of the strap bands disposed on this pocket and described above.

In this connection, the free ends of the two strap bands disposed on the pocket, for example, provided with two reinforcement elements, in each instance, are passed through two loops of the vest that lie above one another.

Subsequently, the reinforcement elements are then inserted into the assigned insertion slits of the pocket, both at the top and at the bottom.

In addition to its very complicated handling, this embodiment also has the particular disadvantage that these pockets, disposed on the strap bands of the vest in such a manner, always sit somewhat loosely on the vest, since after insertion of the reinforcement elements into the related insertion slits, a loop necessarily forms all the time.

When using such pocket/vest combinations, particularly in connection with army vests and/or police vests, this fastening variant necessarily results in continuous loosening of the insertion connection, for example when "sliding" along the ground or if the pocket comes to rest on the ground in some other way, as well as when the pocket releasably disposed on the vest "gets caught" on branches or the like, and this loosening can result in loss of the pocket under conditions of use.

Furthermore, because of the insertion and removal of the reinforcement elements into the insertion slits disposed on the pocket, there is the risk of long-term breakage of the reinforcement elements, so that optimal fastening of the pocket to the vest becomes impossible as a result of the wear that necessarily occurs.

U.S. Pat. No. 5,724,707 A now describes a different, slightly modified construction of this previously known fastening system, with analogous use of the vest known from U.S. Pat. No. 5,259,093 A, having strap bands that form loops.

In the case of this embodiment according to U.S. Pat. No. 5,724,707 A, several strap bands are disposed on the back of the pocket, above one another, spaced apart, in the crosswise direction.

The pocket is attached to the vest analogous to U.S. Pat. No. 5,259,093 A, in such a manner that the crosswise straps of the pocket come to rest in the "interstices" between the strap bands of the vest, in each instance.

As in the case of a backpack, two fastening straps are furthermore disposed on the back of the pocket to be disposed on the vest.

In order to connect the pocket with the vest, these straps are passed through, in braided manner, beginning with a loop (accommodation means) on the vest and necessarily ending with a loop on the vest, between the adjacent interlocking strap loops of pocket and vest, analogous to CA 64 22 44, and attached on the pocket with the free end, by means of a fastening element.

One of the disadvantages of this embodiment known from U.S. Pat. No. 5,724,707 A consists in the very time-consuming and difficult braiding process in order to pass the fastening strap, which is disposed on the pocket, between the loops of vest and pocket, which lie very close against one another.

To fasten the lower end of the fastening strap, a snap is disposed as a fastening element, with which snap the free end of the fastening strap is directly fastened to the pocket after its final braiding through the lower loop of the vest.

Also because of this final fastening of the fastening strap to the pocket, the embodiment known from U.S. Pat. No. 5,724,707 A is only conditionally suitable for being fastened to interchangeable articles, for example pockets, on police and army vests, since these snap connections are always subject to very great stress as a result of the lever effect that occurs between the snap and the "last loop" on the article of clothing, when this pocket fastening is subject to extreme stresses under conditions of use, such as when sliding over the ground, but also even when sitting or staying in a squatting position. Because of this stress, the snap already opens when it has become slightly worn and/or slightly dirty.

Another disadvantage of this embodiment also consists in the fact that this fastening variant of the pocket on the vest, known from U.S. Pat. No. 5,724,707 A, clearly stiffens the vest and thereby greatly impairs wearing comfort, particularly when attaching "high" pockets, since when transporting longer objects in the pockets, for example, assigned to the pocket height, the backs of the pockets and therefore necessarily the vest contact area become oriented so flat (stiffened) that deformation of the upper body when bending, for example, is impaired.

Furthermore, the two aforementioned solutions have the following disadvantage in common. For both solutions, it is absolutely necessary that on the article of clothing, in each instance, for example the vest, several strap band woven strips, which are uniformly spaced apart, in each instance, are connected with the vest multiple times, by means of perpendicular attachment seams that are spaced precisely uniformly apart, so that these seams form loops of precisely the same size, disposed precisely above and next to one another, with the article of clothing, for example the vest.

In order to now guarantee precise and reliable fastening with a high degree of functional safety, with simultaneously simple, secure, and fast handling, even under very extreme conditions of use, with great wearing comfort, not only the very precise arrangement of loops that lie uniformly above and next to one another, which also have precisely the same size, is required, but furthermore it is also necessarily required that the loops are always allowed to be only minimally wider than the straps, so that the end pieces of the fastening straps disposed on the pieces of baggage can be passed through the loops so that they just "slide tightly." Under no circumstances are the fastening straps allowed to displace themselves crosswise in the loops, after assembly, to such an extent that the person wearing the vest has the feeling of a constant change in position of the piece of baggage on the vest, for example when running quickly.

Under these requirements, an offset of the loops that is hardly possible to avoid during sewing, in the usual tolerance field, necessary leads to "distortion" of the article of clothing and/or to twisting of the fastening strap. However, this results in a clear impairment of wearing comfort.

Furthermore, practical tests have shown that with an increasing loop size and/or an increasing transport weight, not only is the wearing comfort greatly impaired in the case of clothing straps that are sewn onto the article of clothing, to form loops, but also, the connecting seams of the clothing straps with the article of clothing, even if they are sewn multiple times, will tear open.

In this connection, the perforation of the connected textiles that is caused by the sewing process results in a clear reduction of the strength properties of these fabrics that are connected by means of sewing. Even when applying very great production effort during the sewing process, which is particularly due to the compulsory adherence to a very slight tolerance field during sewing, simple, secure, quick, and freely selectable, precise positioning of pieces of baggage, by means of fastening straps disposed on the pieces of baggage, can only be conditionally guaranteed, particularly under very extreme conditions of use.

The invention is therefore based on the task of eliminating the aforementioned disadvantages of the state of the art, and of developing a fastening system having an interlocking mechanism of effect for objects, for example pockets, to be attached in variable positions on an article of clothing, which system possesses great functional safety and reliability even under extreme conditions of use, is characterized by easy and quick handling, as well as by secure and reliable fastening of the object to be attached in variable positions on the article of clothing, even under very extreme conditions of use, while providing great wearing comfort and a long useful lifetime, additionally increases the variability of transport possibilities, and, at the same time, is easy and inexpensive to produce, in terms of production technology.

According to the invention, this task is accomplished by means of a fastening system for objects, for example pockets (4), to be attached to an article of clothing (1) in variable positions, by means of an interlocking mechanism of effect, having one or more fastening strap(s) (7) disposed on the object to be fastened, as well as a plurality of clothing loops (3) disposed on the article of clothing (1) in the form of "rows and columns" next to and below one another, which are formed, for example, by clothing straps (2) that are sewn onto the article of clothing (1) in multiple manner, underneath one another, at uniform intervals, for example, which system is characterized in that a buckle (12) is disposed on each fastening strap (7), on the object to be attached, below the upper fastening region, and that one or more pocket loops (6) are disposed on the article of clothing (1), in the lower region of the contact surface of the object to be attached, next to one another, in accordance with the number of fastening straps (7) disposed on the object to be attached, whereby a gripper element (8) provided with a hook (9), in each instance, is disposed on the free end of the fastening strap(s) (7) disposed on the object to be attached.

According to the invention, the object to be attached is placed against the article of clothing (1) and the fastening strap (7) disposed on the object to be attached is first passed through one of the clothing loops (3) disposed on the article of clothing (1) and subsequently through the related buckle (12) disposed on the object to be attached, for example the pocket (4).

Afterwards, the fastening strap (7) is still passed only through the clothing loop (3) situated above the pocket loop (6) disposed on the object to be attached, and through the pocket loop (6) adjacent to the former, as well as through the clothing loop (3) situated below the pocket loop (6), and locked in place in the latter by means of the hook (9) disposed on the gripper element (8) of the fastening strap (7).

As a result of the "free" fastening according to the invention, over the pocket height, the wearing comfort is significantly improved even in the case of "high" pockets.

By means of the "two-point fastening" of the pockets on the article of clothing, the vest, according to the invention, the variety of variants of transport possibilities is furthermore increased at the same time, since the wearer of the article of clothing according to the invention has the possibility, when the pocket is in place, to utilize the additional storage space offered by the solution according to the invention, between the pocket and the vest, for example, for short-term transport or interim storage of gloves or magazines, for example.

Furthermore, the solution according to the invention, in combination with the gripper element (8) that reinforces the free end of the fastening strap (7), furthermore guarantees very simple, quick handling, as well as, in combination with the hook (9), secure and reliable fastening of the object to be placed in variable positions on the article of clothing (1), even under very extreme conditions.

At the same time, the solution according to the invention always results in great functional security and reliability, even under very extreme conditions of use, in combination with the reliable and robust, simple and quick, optimal handling of fastening the fastening strap by means of the hook (9) disposed on the gripper element (8), directly to a clothing loop (3), and is characterized not only by simple and quick handling with secure and reliable fastening even under extreme conditions, but also by a long useful lifetime.

Therefore this solution according to the invention is particularly suitable also for army and police vests.

Furthermore, the solution according to the invention can be produced in simple and also very inexpensive manner, in terms of production technology.

Particularly advantageous embodiments are indicated in the dependent claims 2 to 5.

It is preferred that an engagement projection (10) is disposed on the end of the hook (9), whereby the hook length corresponds approximately to the width of the clothing straps (7), so that the great reliability according to the invention is very advantageously guaranteed, even under very extreme conditions of use.

It is furthermore advantageous that gripper depressions (11) are disposed on the gripper element (8).

The arrangement of gripper depressions according to the invention allows an additional improvement of the handling of the system according to the invention, particularly when passing the fastening strap (7) through the loops/buckles of the article of clothing (1) and, for example, of the pocket (4).

It is also advantageous that in the assembled state, at least part of the gripper element (8) that is disposed on the free end of the fastening strap (7) projects beyond the object to be attached, for example the pocket (4).

In this way, optimal handling of the system according to the invention is achieved.

It is furthermore advantageous that the pocket loop(s) (6) disposed in the lower region of the contact surface of the object to be fastened to the article of clothing, for example the pocket (4), is/are formed by one or more strap band(s), the pocket strap(s) (5).

This allows simple production of the pocket loops (6) disposed on the pocket.

It is also characteristic that the clothing loops (3) are formed by clothing repeat bands (15) disposed on/in the article of clothing (1) singly or in multiple manner, below one another, at uniform intervals, which consist of a clothing band (16), which are interwoven with the woven fabric of the clothing band (16), with several clothing straps (2), disposed precisely below one another, in uniformly recurring height and width repeats.

Such clothing repeat bands (15) can be produced very inexpensively within the framework of band or strap weaving, and are characterized both by significantly greater dimensional accuracy in the loop geometry, and by a significantly greater durability of the woven connection as compared with a sewn connection, as compared with a clothing strap (2) that is sewn onto the clothing, forming loops.

At the same time, the impairment in strength that necessarily occurs due to the perforation of the woven fabric during sewing is also avoided, so that even with an increasing transport weight, the connections between the clothing straps and the clothing band are prevented from tearing open.

Furthermore, very precise and reliable fastening, with great functional security and, at the same time, simple, secure, and quick handling, along with great wearing comfort, can be guaranteed by the solution according to the invention, particularly also in combination with the very precise arrangement of loops that always have the same size and lie uniformly above and next to one another.

Furthermore, it can also be assured, with minimal effort, that all of the loops are always only minimally wider than the straps, so that the end pieces of the fastening straps disposed on the pieces of baggage can always be passed through the loops "sliding tightly," and in this way, the wearer of the vest is given the feeling of tight positioning of the piece of baggage, in each instance, on the vest, even while running rapidly.

Furthermore, the use of the woven clothing repeat bands (15) according to the invention allows optimal, multiple, precise coordinated placement of loops that always have precisely the same size, at minimized production tolerance.

Furthermore, a very precise column-type loop arrangement can be established by means of the use of the clothing repeat bands (15) according to the invention, even when several clothing repeat bands are to be disposed below one another, in very simple and inexpensive manner, as early as when the clothing is cut out, so that offset of the loops relative to one another can be avoided with minimal technological effort, by means of the use of the solution according to the invention.

When using the solution according to the invention, it is therefore also guaranteed that even under extreme transport conditions, no impairment of wearing comfort can occur in any case, due to "distortion" of the article of clothing and/or "twisting" of the fastening strap.

Furthermore, when using the solution according to the invention, simple, reliable, secure, quick handling and freely selectable, precise positioning and attachment of pieces of baggage is always guaranteed, even under very extreme conditions of use, with great wearing comfort and a long useful lifetime, with great variety of the variants of transport possibilities, by means of the fastening straps disposed on the pieces of baggage.

It is also essential to the invention that the clothing repeat bands (15) are sewn onto the woven fabric of the articles of clothing (1).

In this way, a long useful lifetime can be guaranteed even under very extreme conditions of use.

It is furthermore characteristic that the clothing repeat bands (15) form the articles of clothing (1), in combination with other materials, for example net materials.

Such embodiments allow simple and inexpensive production of highly breathable articles of clothing (1) for extreme conditions of use, with great wearing comfort.

The invention will now be explained in greater detail, using several exemplary embodiments, in connection with eight representations.

Figure 2:
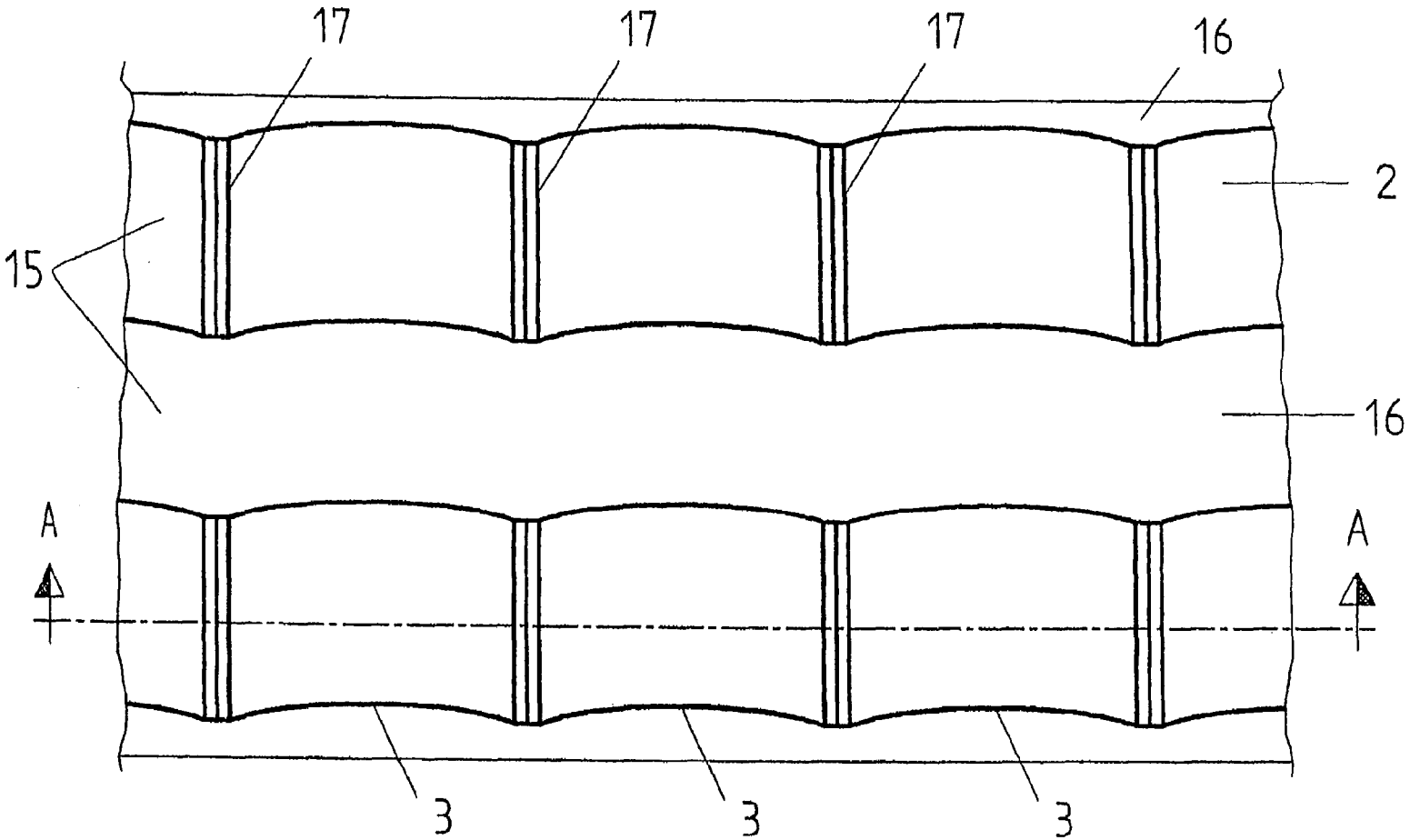
Figure 3:
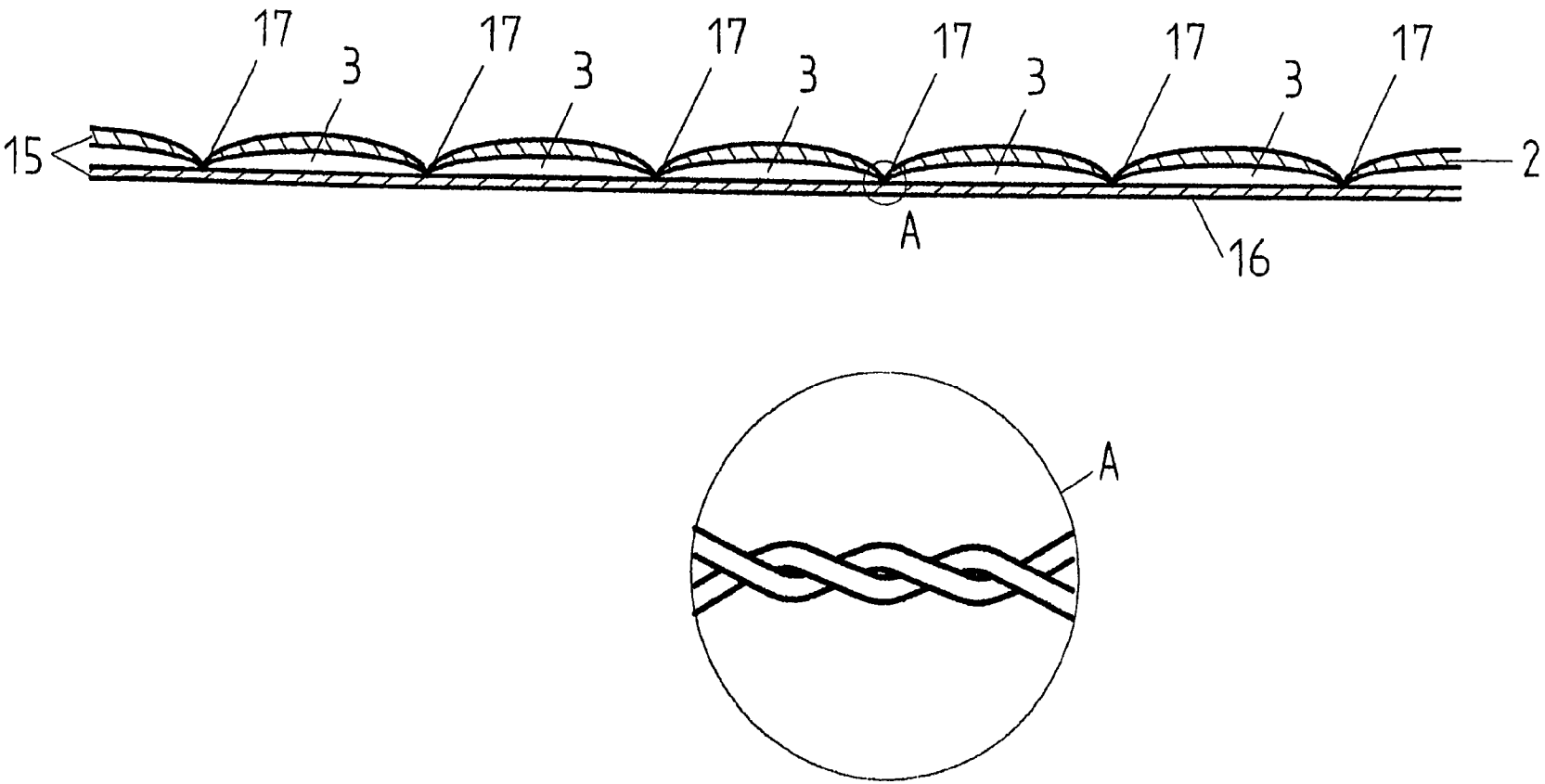
Figure 4:
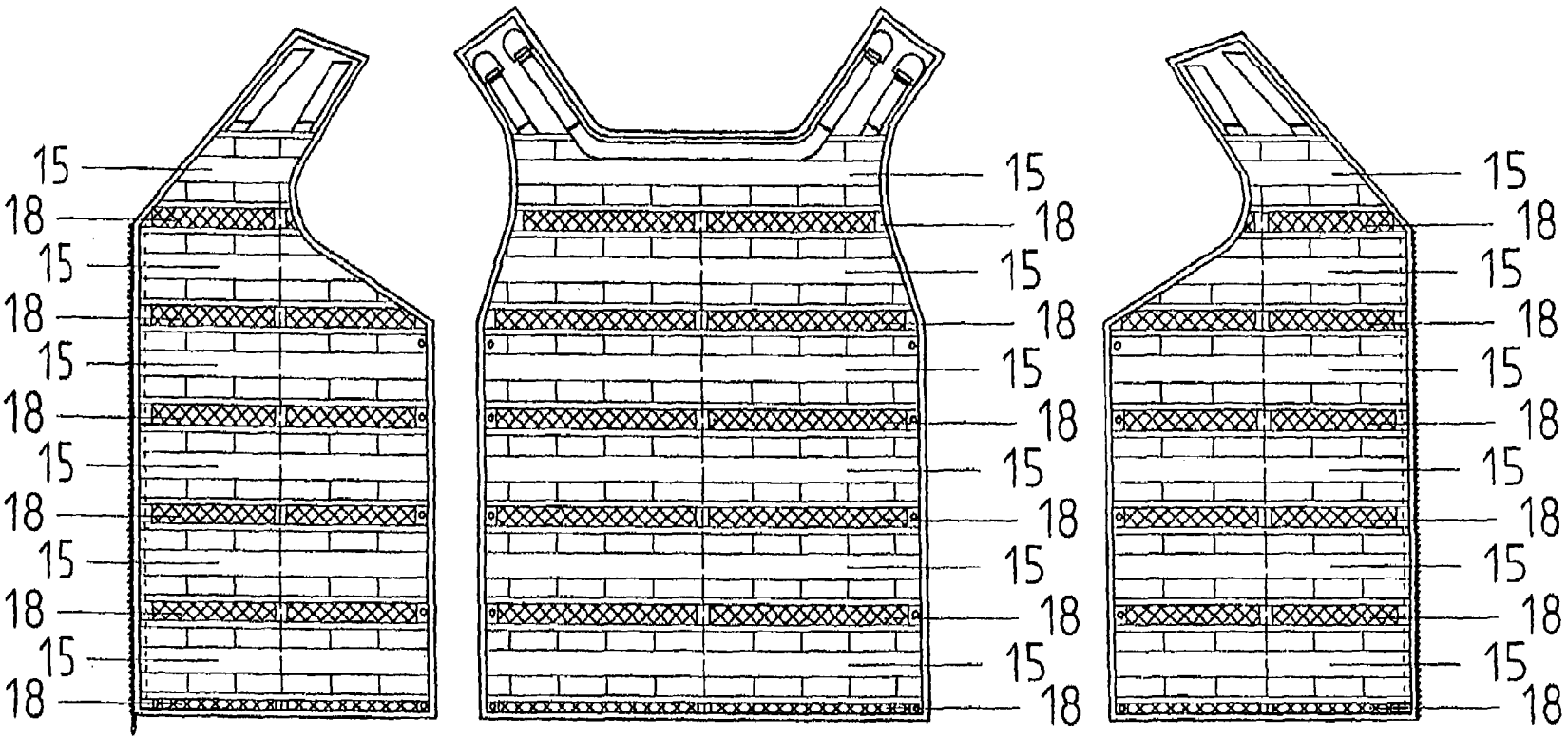
Figure 5:
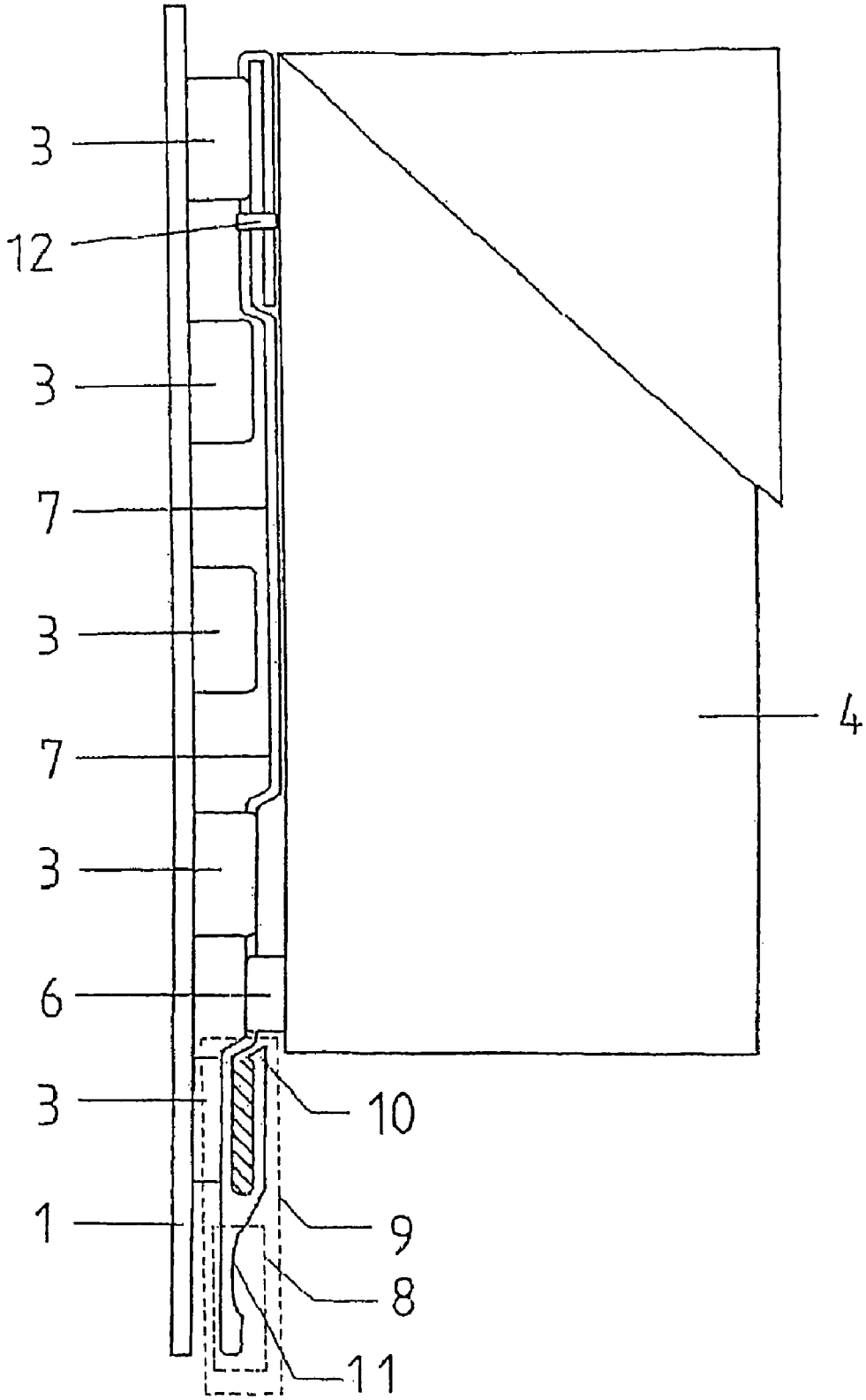
Figure 6:
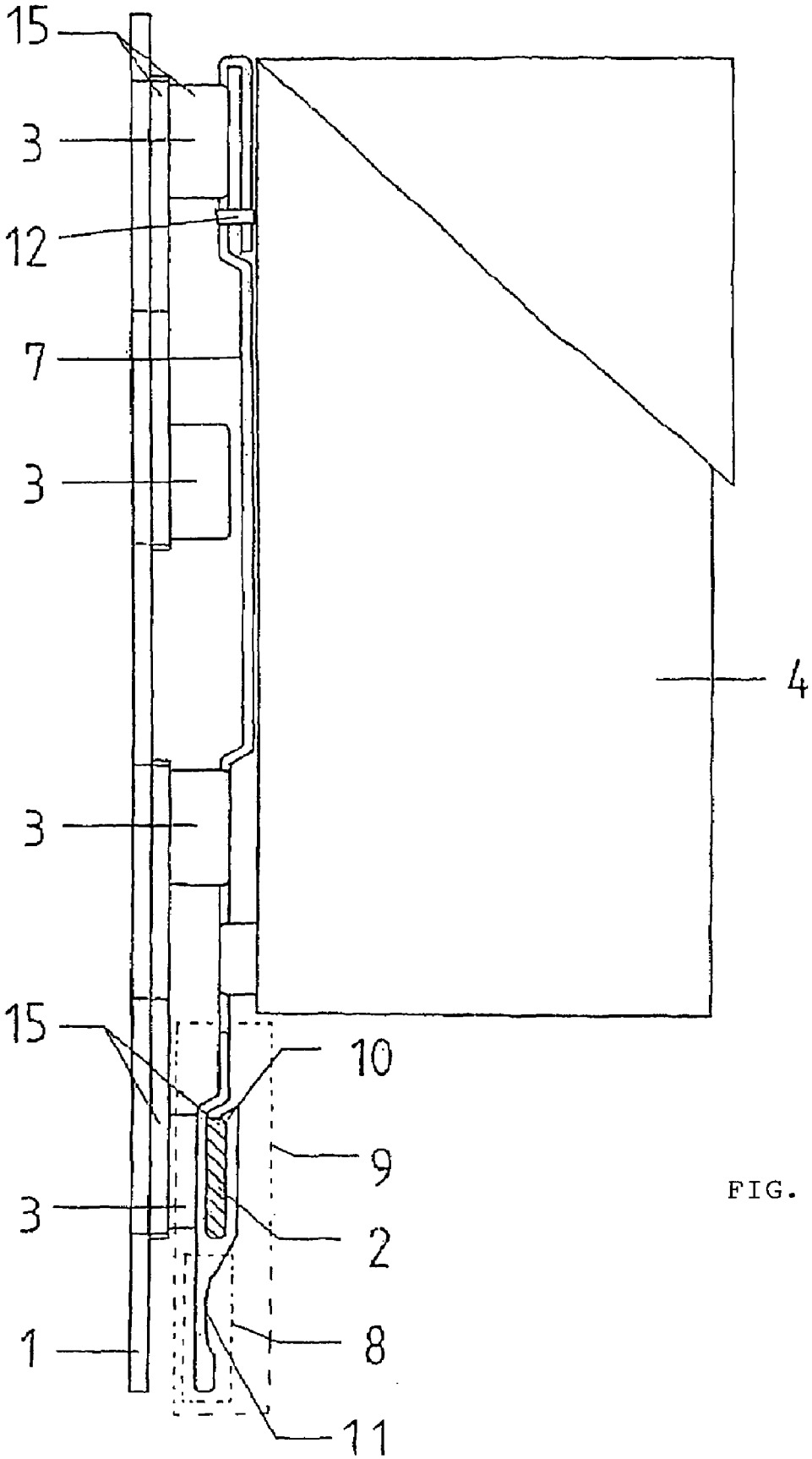
Figure 7:
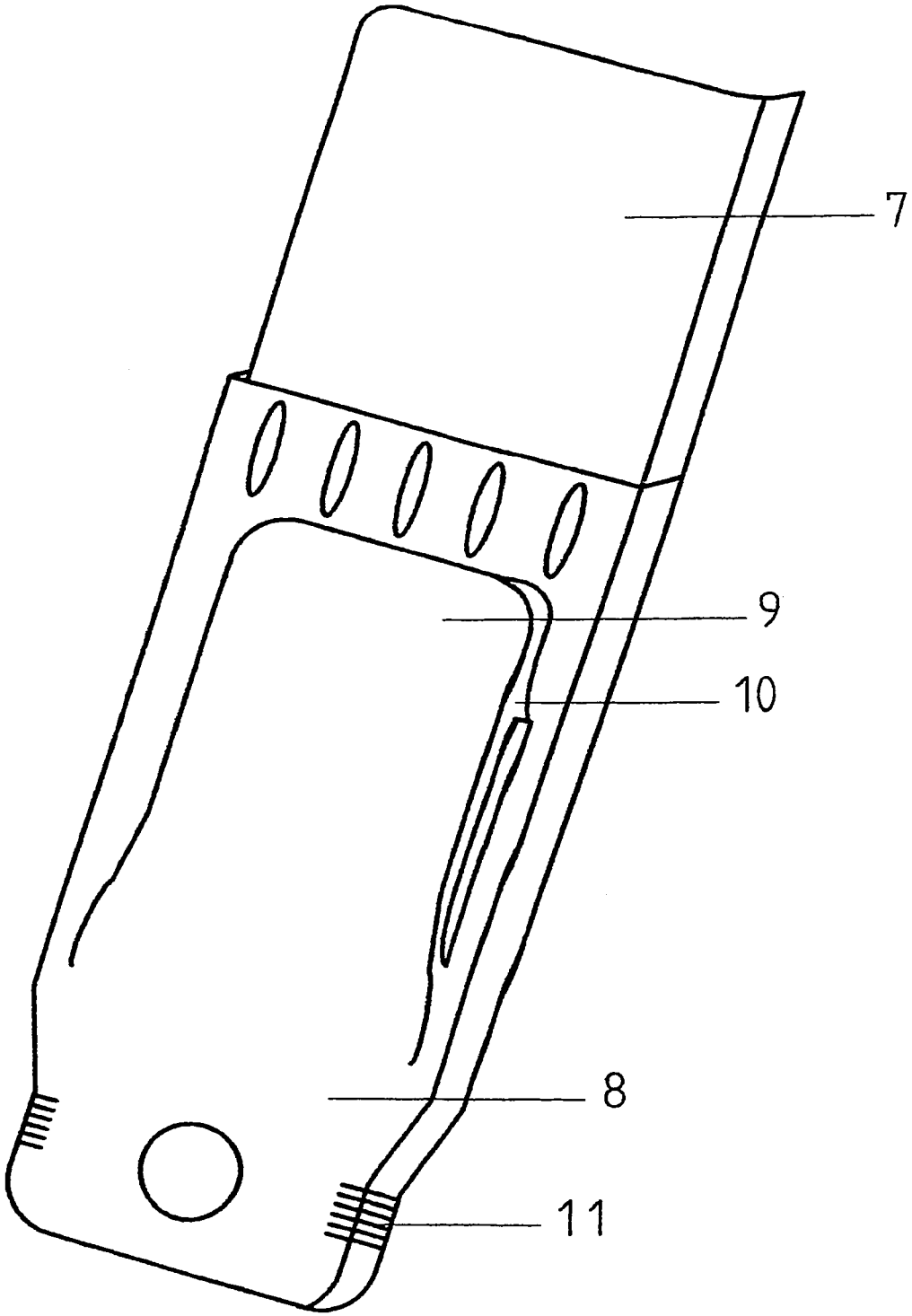
Figure 8:
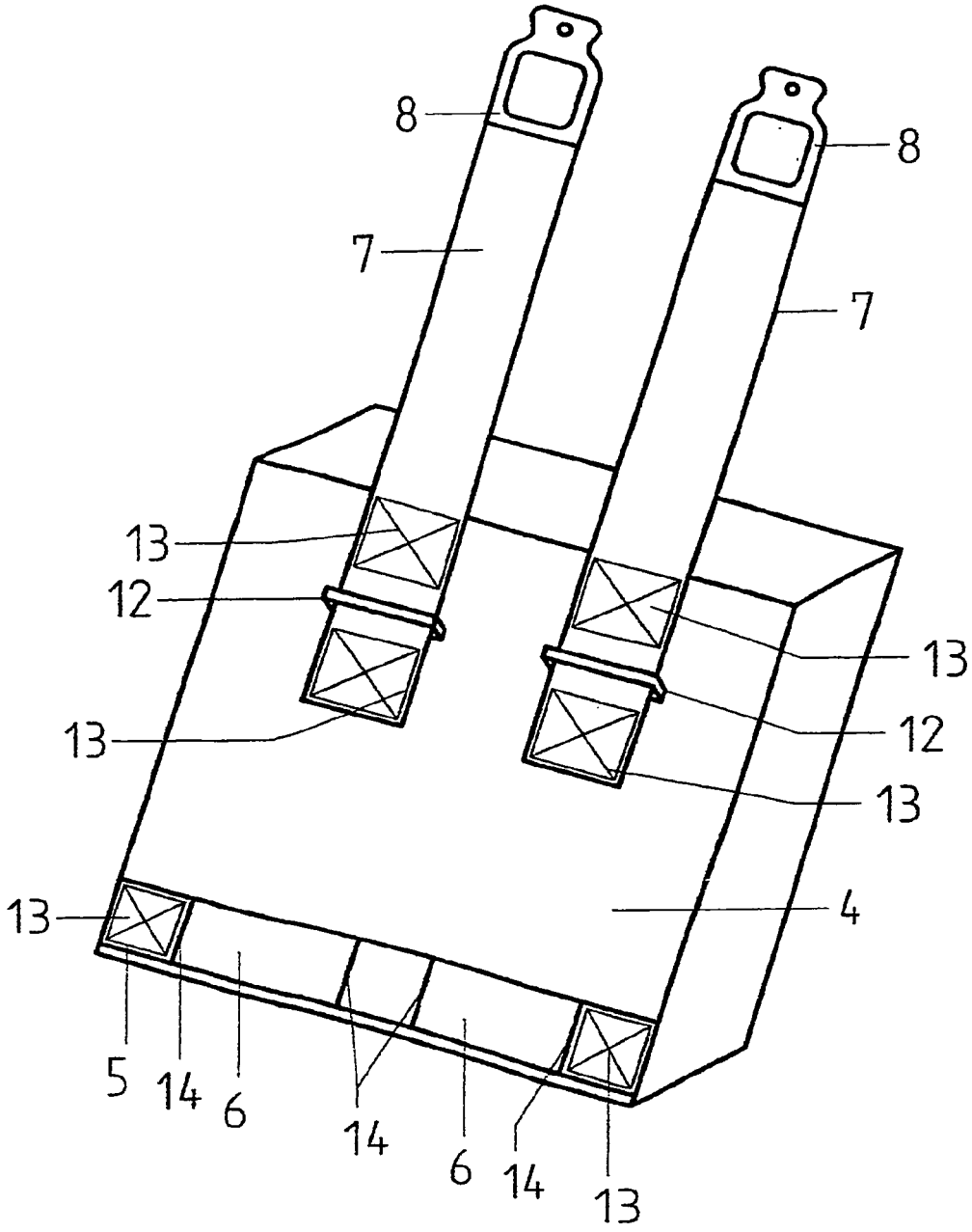

These show:

FIG. 1: a three-dimensional representation of an article of clothing 1 that finds use in the solution according to the invention, in the form of a vest;

FIG. 2: a schematic three-dimensional representation of a clothing repeat band 15 according to the invention;

FIG. 3: a section at A-A, according to FIG. 1, through the clothing repeat band 15 according to the invention;

FIG. 4: a possible embodiment of the placement of the clothing repeat bands 15 according to the invention on an article of clothing 1 that finds use in combination with the solution according to the invention, in the form of a vest;

FIG. 5: a side view of the placement according to the invention of a pocket 4 on an article of clothing 1, in partial cross-section;

FIG. 6: a side view of the placement according to the invention of a pocket 4 on an article of clothing 1 provided with the clothing repeat bands 15 according to the invention, in partial cross-section;

FIG. 7: a possible embodiment of a gripper element 8 disposed on the fastening strap 7, according to the invention, in a three-dimensional representation;

FIG. 8: a back view of a pocket configured according to the invention, in a three-dimensional representation.

FIG. 1 shows a three-dimensional representation of an article of clothing 1 that finds use in the solution according to the invention, in the form of a vest, with clothing loops 3 that are formed by clothing straps 2, disposed on the latter.

The clothing straps 2 that are disposed on the article of clothing, spaced apart, are sewn to the article of clothing, in perpendicular manner, by means of Z locks 14, preferably at uniform intervals, and thereby form a plurality of clothing loops 3 disposed on the article of clothing 1 next to and below one another, in the form of "rows and columns."

FIG. 2 shows a schematic three-dimensional representation of a clothing repeat band 15 according to the invention.

The clothing repeat band 15 consists of a clothing band 16 that, together with several clothing straps 2 that are disposed precisely below one another, at uniformly recurring height and width repeats, is woven together with the woven fabric of the clothing band 16, by means of woven connections 17, in such a manner that precisely uniform clothing loops 3, disposed precisely next to and below one another, are formed between the clothing band 16 and the clothing strap 2.

FIG. 3 shows the section at A-A, according to FIG. 1, through the clothing repeat band 15 according to the invention. From this representation, it is evident how the clothing band 16, together with the clothing strap 2, is woven to the woven fabric of the clothing band 16, in uniformly recurring repeats.

Such clothing repeat bands 15 can be produced very inexpensively within the framework of band or strap weaving, and are characterized both by significantly greater dimensional accuracy in the loop geometry, and by a significantly greater durability of the woven connection as compared with a sewn connection, as compared with a clothing strap 2 that is sewn onto the clothing, forming loops, since the perforation that necessarily occurs during sewing is avoided.

FIG. 4 shows a possible embodiment of the placement of the clothing repeat bands 15 according to the invention on an article of clothing 1 that finds use in combination with the solution according to the invention, in the form of a vest.

In this exemplary embodiment, the clothing repeat bands 15, in combination with net material 18, form the article of clothing 1, the vest.

By means of the use of the clothing repeat bands 15 according to the invention, a very precise loop arrangement can be established, even when there are several clothing repeat bands 15 to be disposed below one another, simply by means of a precise cut-out, so that offset of the loops relative to one another is avoided with minimal technological effort.

The use of the woven clothing repeat bands 15 according to the invention thereby allows quick, inexpensive, optimal, multiple precise placement below one another of loops 3 that always have precisely the same size, with a minimized production tolerance.

Furthermore, the use of the clothing repeat bands 15 guarantees that when using the solution according to the invention, even under extreme transport conditions, no impairment of wearing comfort resulting from "distortion" of the article of clothing and/or "twisting" of the fastening strap can occur, whereby at the same time, simple, reliable, secure, quick handling and freely selectable, precise positioning and fastening of pieces of baggage, by means of the fastening straps disposed on the pieces of baggage, is guaranteed even under very extreme conditions of use, with great wearing comfort and a long useful lifetime, and with a great variety of variants of the transport possibilities.

FIG. 5 shows a side view of the placement according to the invention of a pocket 4 on an article of clothing 1, in partial cross-section.

Several pocket loops 6 are disposed in the lower region of the contact surface of the pocket 4 to be fastened to the article of clothing 1, next to one another. A gripper element 8 is disposed on the lower end of the fastening straps 7 disposed on the pocket 4, in each instance. These gripper elements 8 are provided with a hook 9.

According to the invention, the pocket 4 is connected with the article of clothing as shown in FIG. 5.

In this connection, the pocket 4 is first placed against the article of clothing 1, and the fastening strap 7 disposed on the pocket 4 is first passed through one of the clothing loops 3 disposed on the article of clothing 1, and then through the related buckle 12 disposed on the pocket 4.

The fastening strap 7 is subsequently still passed only through the clothing loop 3 situated above the pocket loop 6 disposed on the object to be attached, and subsequently through the pocket loop 6 adjacent to the former, and last through the clothing loop 3 situated below the pocket loop, and locked in place in the latter by means of the hook 9 disposed on the gripper element 8 of the fastening strap 7.

By means of this "two-point fastening" of the pockets on the article of clothing, the vest, according to the invention, the variety of variants of transport possibilities is increased at the same time, since the wearer of the article of clothing according to the invention has the possibility, when the pocket is in place, to utilize the additional storage space offered by the solution according to the invention, between the pocket and the vest, for example, for short-term transport or interim storage of gloves or magazines, for example.

As a result of this "free" fastening according to the invention, over the pocket height, particularly in the case of "high" pockets, the freedom of movement of the wearer is also significantly improved as compared with conventional fastening systems, since the related articles of clothing are not stiffened in board-like manner, as in conventional fastening systems, by means of the pockets and their contents. This results in a clear improvement of the freedom of movement and the wearing comfort for the user of the system according to the invention.

The solution according to the invention, in combination with the gripper element 8 that reinforces the free end of the fastening strap 7, results in reliable and robust, simple and quick, optimal handling of fastening the fastening strap 7 with its gripper element 8 and by means of the hook 9 directly to a clothing loop 3, so that even under very extreme conditions, great functional security and reliability, with secure and reliable fastening, always exists even under extreme conditions, with a long useful lifetime.

As shown in FIG. 5, an engagement projection 10 is disposed on the hook 9, approximately at the height of the width of the clothing straps 2.

In this way, the required great reliability is guaranteed in particularly advantageous manner even under very extreme conditions of use, so that this solution according to the invention is particularly suitable also for army and police vests.

A gripper depression 11 is disposed on the gripper element 8. This allows an improvement in the handling of the system according to the invention, particularly when passing the fastening strap 7 through the loops/buckles of the article of clothing 1 and the pocket 4 that are adjacent to one another.

The greatest part of the gripper element 8 disposed on the free end of the fastening strap 7 projects beyond the pocket 4 to be attached, in the final assembled state, thereby achieving optimal handling of the system according to the invention.

FIG. 6 shows now a side view of the placement according to the invention of a pocket 4 on an article of clothing 1 provided with the clothing repeat bands 15 according to the invention, in partial cross-section.

In this connection, it is also essential to the invention that the clothing repeat bands 15 provided with the loops 3 are sewn onto the woven fabric of the article of clothing 1, so that even under very extreme conditions of use, a long useful lifetime and reliability can always be guaranteed.

Several pocket loops 6 are disposed next to one another, again, in the lower region of the contact surface of the pocket 4 to be fastened to the article of clothing 1. Again, a gripper element 8 is disposed on the lower end of the fastening straps 7 disposed on the pocket 4, in each instance. These gripper elements 8 are provided with a hook 9, according to the invention.

According to the invention, the pocket 4 is connected with the article of clothing 1 that is provided with clothing repeat bands 15 here, as shown in FIG. 6, analogous to the above explanations relating to FIG. 5.

By means of the use of clothing repeat bands 15 according to the invention, even more precise and greatly reliable fastening of pockets, for example, is guaranteed, in addition to the advantages already explained in connection with FIG. 5, with great functional security and, at the same time, simple, secure, and quick handling, even under very extreme conditions of use, with very great wearing comfort, by means of the very precise, high-strength placement of loops that always have precisely the same size, and lie uniformly above and next to one another.

In addition, at the same time, it can be assured with minimal effort that the loops are only minimally wider than the straps, so that the end pieces of the fastening straps disposed on the pieces of baggage can always be passed through the loops "sliding tightly," so that in this way, the wearer of the vest is given the feeling of fixed positioning of the piece of baggage on the vest even when running quickly. Even with an increasing loop size and/or increasing transport weight, the woven connection 17 between the clothing straps and the clothing band 16 simultaneously prevents these connections from being torn open.

By means of the "two-point fastening" of the pocket 4 on the clothing repeat bands 15 of the article of clothing 1, in the case of this embodiment of the solution according to the invention, as well, not only the wearing comfort but at the same time, also the variety of variants of transport possibilities is increased, since the wearer of the article of clothing according to the invention has the possibility, when the pocket is in place, to utilize the additional storage space offered by the solution according to the invention, between the pocket and the article of clothing 1, for example, for short-term transport or interim storage of gloves or magazines, for example.

FIG. 7 now shows a possible embodiment of a gripper element 8 having a hook 9, an engagement projection 10, and gripper depressions 11, disposed on the fastening strap 7, according to the invention, in a three-dimensional representation.

This construction of the gripper element 8, "injection-molded onto" the fastening strap 7, guarantees not only great reliability but, at the same time, simple and inexpensive production, in terms of production technology.

FIG. 8 shows a back view of a pocket 4 configured according to the invention, in a three-dimensional representation.

The two fastening straps 7, provided with gripper elements 8 at their free ends, are attached to the back of the pocket 4 twice by means of an X seam 13, in each instance, in such a manner that a buckle 12 pushed onto the pocket strap between the two X seams, before the lower X seam 13 is sewn, is precisely positioned on the pocket 4.

In the lower region of the pocket 4, there is the pocket strap 5, sewn onto the pocket 4 in the crosswise direction of the strap band.

This strap is attached to the back of the pocket 4 with an X seam 13, in each instance.

The pocket loops 6, which lie on the pocket 4 perpendicular below the attachments of the fastening strap 7, are formed by additional connections of the pocket strap 5 with the pocket 4, by means of Z locks 14 that run over the entire width of the pocket strap and are disposed on both sides of each pocket loop 6.

In this way, simple, precise, inexpensive to produce and functionally secure placement of the fastening straps 7, the buckles 12, and pocket loops 6 on the pocket 4 can be guaranteed.

Using the solution according to the invention, it has therefore been possible to develop a fastening system having an interlocking mechanism of effect for objects, for example pockets, to be disposed on an article of clothing in variable positions, which system always possesses great functional security and reliability even under extreme conditions of use, is characterized by simple, quick handling as well as by secure and reliable fastening of the object to be disposed in variable positions on the article of clothing, even under very extreme conditions of use, with great wearing comfort and a long useful lifetime, in addition increases the variety of variants of the transport possibilities, and at the same time is simple and inexpensive to produce, in terms of production technology.

REFERENCE SYMBOL LIST

1 article of clothing
2 clothing strap
3 clothing loop
4 pocket
5 pocket strap
6 pocket loop
7 fastening strap
8 gripper element
9 hook
10 engagement projection
11 gripper depression
12 buckle
13 X seam
14 Z lock
15 clothing repeat band
16 clothing band
17 interweaving
18 net material

The invention claimed is:

1. A fastening system for attaching objects to an article of clothing in various positions comprising:

(a) a plurality of fastening straps disposed on an object to be fastened, each fastening strap having a free end;

(b) a plurality of clothing loops disposed on the article in a row and column arrangement next to and below one another, each clothing loop having a width;

(c) a plurality of buckles, each buckle disposed on a respective fastening strap below an upper fastening region;

(d) a plurality of pocket loops disposed next to one another on the article of clothing in a lower region of a contact surface of the object to be attached, each pocket loop associated with a respective one of said plurality of fastening straps; and (e) a plurality of gripper elements, each gripper element having a hook disposed on the free end of a respective fastening strap disposed on the object to be attached for locking the fastening strap in place on a corresponding one of said plurality of clothing loops below the respective pocket loop, each hook having a hook end and an engagement projection disposed on the hook end, the hook having a hook length corresponding approximately to the width of the clothing loop.

2. The fastening system according to claim 1, wherein at least part of the gripper element that is disposed on the free end of the fastening strap projects beyond the object to be attached in an assembled state.

3. The fastening system according to claim 1, wherein the objects to be attached are pockets and the clothing loops comprise clothing straps sewn onto the article of clothing underneath one another at uniform intervals.

4. The fastening system according to claim 3, wherein the clothing loops are formed by clothing repeat bands disposed on or in the article of clothing singly or in multiple manner, below one another, at uniform intervals, each repeat band comprising a clothing band interwoven with a respective one of the clothing straps, the clothing straps being disposed precisely below one another, in uniformly recurring height and width repeats.

5. The fastening system according to claim 4, wherein the clothing repeat bands are sewn onto the woven fabric of the article of clothing.

6. The fastening system according to claim 4, wherein the clothing repeat bands form the article of clothing in combination with other materials.

7. The fastening system according to claim 1, wherein each pocket loop disposed in the lower region of the contact surface of the object to be fastened to the article of clothing is formed by at least one strap band.

8. A fastening system for attaching objects to an article of clothing in various positions comprising:

(a) a plurality of fastening straps disposed on an object to be fastened, each fastening strap having a free end;

(b) a plurality of clothing loops disposed on the article in a row and column arrangement next to and below one another;

(c) a plurality of buckles, each buckle disposed on a respective fastening strap below an upper fastening region;

(d) a plurality of pocket loops disposed next to one another on the article of clothing in a lower region of a contact surface of the object to be attached, each pocket loop associated with a respective one of said plurality of fastening straps; and (e) a plurality of gripper elements, each gripper element having a plurality of gripper depressions and a hook disposed on the free end of a respective fastening strap disposed on the object to be attached for locking the fastening strap in place on a corresponding one of said plurality of clothing loops below the respective pocket loop.

* * * * *